US006634712B2

(12) United States Patent
Gamble

(10) Patent No.: US 6,634,712 B2
(45) Date of Patent: Oct. 21, 2003

(54) CHILD'S STOOL

(76) Inventor: Carol D. Gamble, 9980 Canvasback Cir., Shreveport, LA (US) 71106

( * ) Notice: Subject to any disclaimer, the term of this patent is extended or adjusted under 35 U.S.C. 154(b) by 0 days.

(21) Appl. No.: 10/045,051

(22) Filed: Jan. 15, 2002

(65) Prior Publication Data

US 2003/0132655 A1 Jul. 17, 2003

(51) Int. Cl.[7] ..... A47C 1/02

(52) U.S. Cl. ..... 297/338; 297/440.23; 297/487; 297/440.1

(58) Field of Search ..... 297/338, 440.23, 297/440.1, 487, 440.2

(56) References Cited

U.S. PATENT DOCUMENTS

| | | | | | |
|---|---|---|---|---|---|
| 2,550,811 | A | | 5/1951 | Herbert | 297/338 |
| 2,570,687 | A | | 10/1951 | Kahn | 297/338 |
| 2,775,285 | A | | 12/1956 | Moreland | 297/338 |
| 3,724,895 | A | | 4/1973 | Brand | 297/338 |
| 4,148,106 | A | * | 4/1979 | Gallien | 5/296 |
| 4,266,306 | A | | 5/1981 | Lee | 297/338 |
| 4,798,412 | A | | 1/1989 | Kohus et al. | 297/338 |
| 4,854,638 | A | * | 8/1989 | Marcus et al. | 297/256.11 |
| 5,599,258 | A | * | 2/1997 | Stone et al. | 482/52 |
| 5,634,687 | A | | 6/1997 | Gamble | 297/338 |
| 5,890,767 | A | * | 4/1999 | Chang | 297/440.14 |

* cited by examiner

*Primary Examiner*—Peter M. Cuomo
*Assistant Examiner*—Erika Garrett
(74) *Attorney, Agent, or Firm*—Brady, O'Boyle & Gates

(57) ABSTRACT

A child's stool having a pair of horizontally spaced, parallel, vertically extending side walls, each having a pair of receivers provided therein. Each receiver includes a vertically extending slot communicating with a plurality of vertically extending inclined slots. A floor is provided having rods cooperating with the receiver slots so that the height of the floor above the ground can be varied so that the stool can accomodate children of various sizes.

2 Claims, 2 Drawing Sheets

CHILD'S STOOL

BACKGROUND OF THE INVENTION

In applicant's U.S. Pat. No. 5,634,687, dated Jun. 3, 1997, there is disclosed a child's stool to help children extend their reach to elevated areas, such as sinks for washing their hands. The stool comprises, essentially, a pair of horizontally spaced, parallel, vertically extending side walls having a plurality of vertically spaced, horizontally extending tongues integral with the inner surfaces of each side wall. A floor is removably supported on a selected pair of oppositely extending tongues, whereby the floor can be adjustably positioned to accomodate children of various sizes.

While the child's stool disclosed-in the above-mentioned patent has been satisfactory for its intended purpose, the child's stool of the present invention is an improvement thereon whereby the removable floor is more securely supported by the side walls of the stool.

SUMMARY OF THE INVENTION

The child's stool of the present invention comprises, essentially, a pair of horizontally spaced, parallel, vertically extending side walls having a vertically adjustable floor or platform extending therebetween. The adjustability of the floor is provided by a receiver provided in each side wall. Each receiver comprises a vertically extending slot communicating with a plurality of vertically spaced inclined notches adapted to receive a respective transversely extending dowel or rod secured to the lateral edges of the floor.

By this construction and arrangement, the floor can be adjusted to the desired position by sliding the floor rods in the vertically extending slots of the receivers and then inserting them into the desired inclined slot to thereby substantially lock the floor at the desired position.

DESCRIPTION OF THE PREFERRED EMBODIMENT

Figure 2:
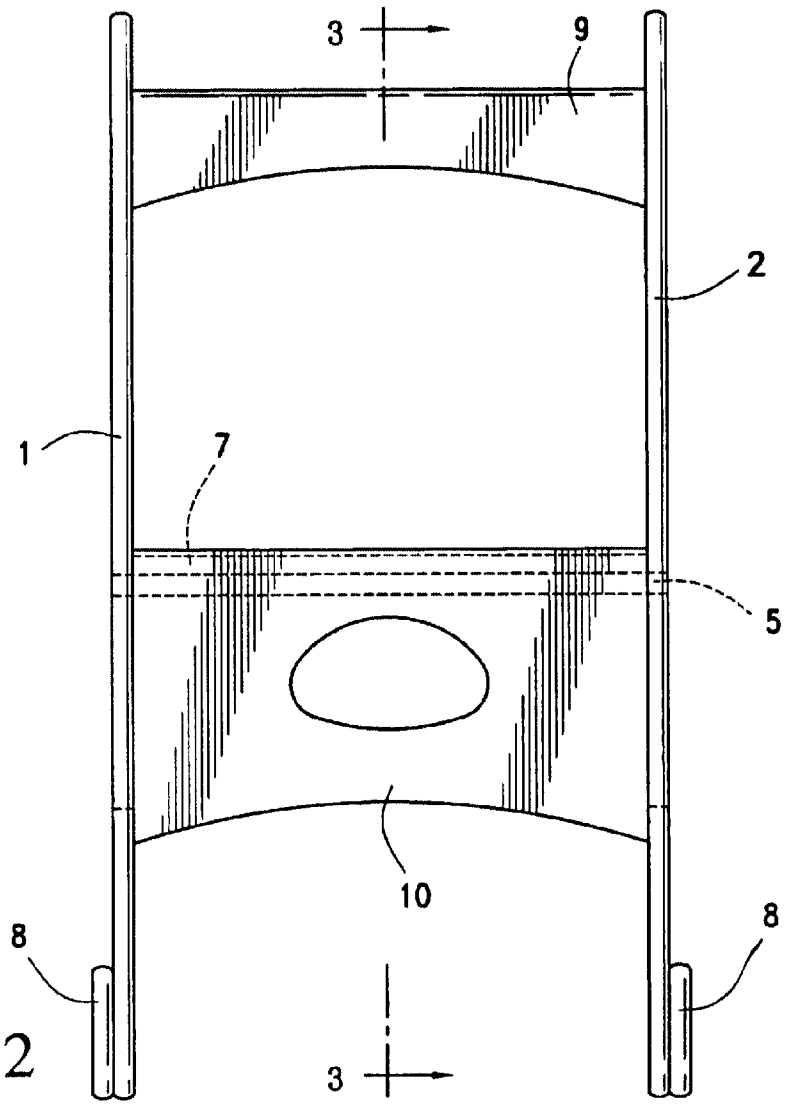
FIG. 2 is a front elevational view of the stool shown in FIG. 1.
Figure 1:
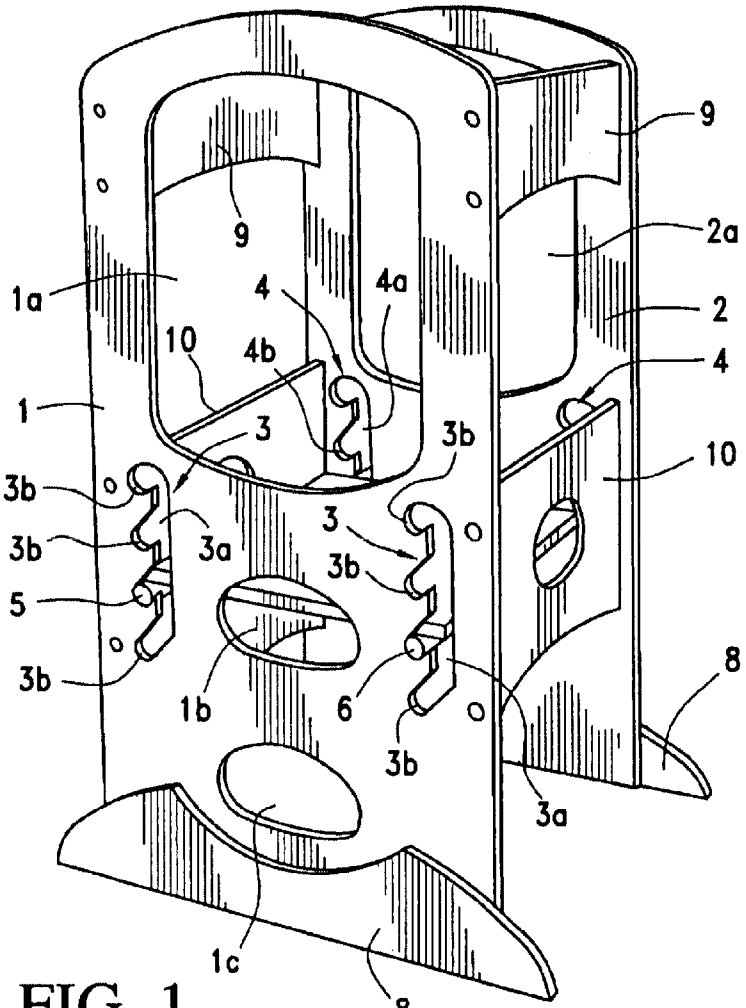
FIG. 1 is a perspective view of the child's stool of the present invention.
Figure 4:
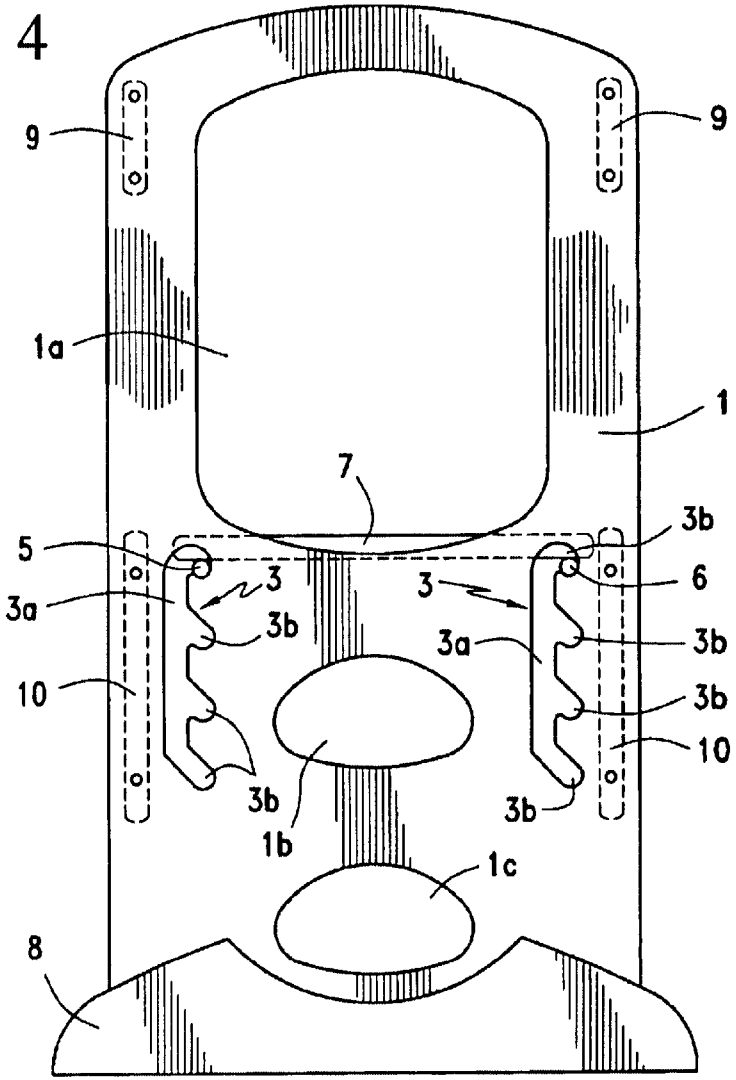
FIG. 4 is a side elevational view of the stool shown in FIG. 1.
Figure 3:
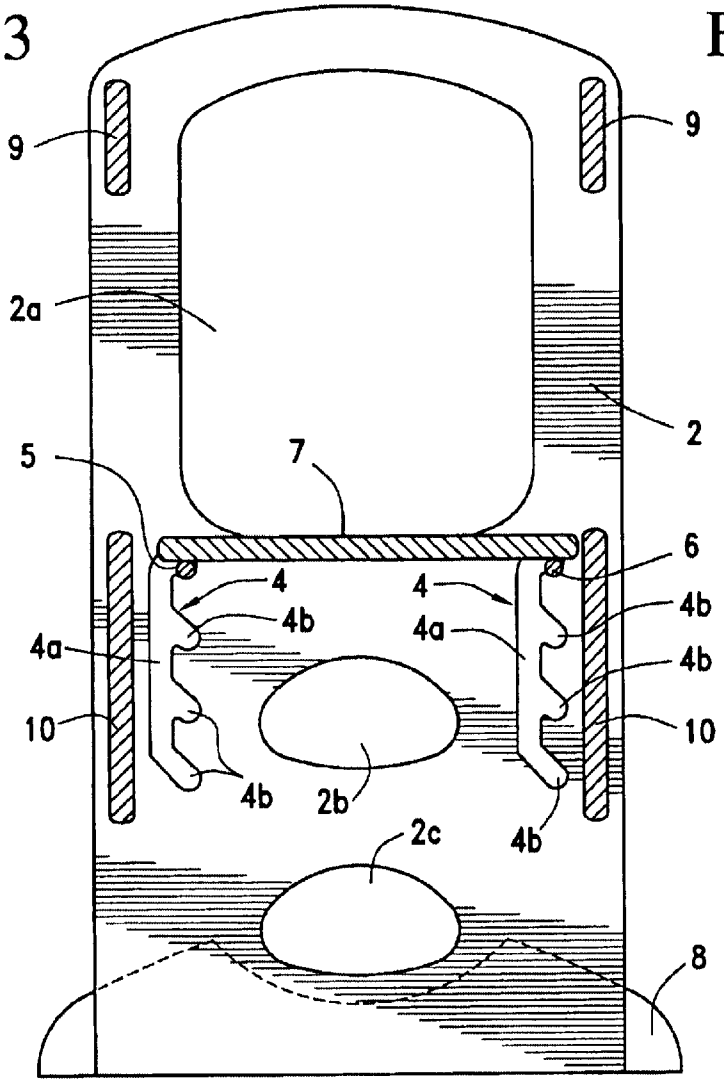
FIG. 3 is a view taken along line 3—3 of FIG. 2.

Referring to the drawings and more particularly to FIGS. 1 and 3, the child's stool of the present invention comprises a pair of horizontally spaced, parallel, vertically extending side walls or panels 1 and 2, each having a respective pair of receivers 3 and 4. Each receiver comprises a vertically extending slot 3*a*, 4*a* communicating with a plurality of vertically spaced inclined slots 3*b*, 4*b*. Each inclined slot 3*b*, 4*b* is adapted to selectively receive the extended end portions of a pair of transversely extending rods 5 and 6 integral with the bottom surface of a floor or platform 7.

Openings 1*a*, 1*b*, 1*c*; and 2*a*, 2*b*, and 2*c* are provided in the side walls to provide ladders or foot holes so that a child can climb onto the floor 7 from the side of the stool, and the lower portions of each side wall 1 and 2 are provided with integral feet 8 for supporting the stool on the floor.

The side panels 1 and 2 are held in the horizontally spaced, parallel, vertically extending position by transversely extending panels 9 and 10 integrally connected at each end thereof to the side walls 1 and 2.

To adjust the height of the floor 7 above the ground, as shown in FIGS. 1 and 3, the floor 7 and associated rods 5 and 6, is manually lifted to remove the rods 5 and 6 from the inclined slots 3*b* and 4*b* into the vertical slots 3*a*, 4*a*. The floor 7 is then moved vertically to align the rods 5 and 6 with selected pairs of inclined slots 3*b* and 4*b*, whereupon the rods 5 and 6 are inserted into the selected pairs of slots 3*b* and 4*b* to once again fasten the floor 7 at a selected height.

From the above description it will be readily appreciated by those skilled in the art that the child's stool of the present invention is an improvement on previous children's stools having adjustable floors in that the adjustable floor of the present invention is more securely supported by the side walls of the stool and the floor can be moved to various adjusted positions without removing the floor from the confines of the stool.

It is to be understood that the form of the invention herewith shown and described is to be taken as a preferred example of the same, and that various changes in the shape, size and arrangement of parts may be resorted to, without departing from, the spirit of the invention or scope of the subjoined claims.

I claim:

1. A child's stool comprising a pair of horizontally spaced, parallel, vertically extending side walls, transversely extending panels integrally connected at each end thereof to said side walls for holding said side walls in the horizontally spaced, parallel, vertically extending position, a floor positioned within the confines of the side walls and panels, at least one transversely extending rod integral with the floor, and at least one receiver provided in each side wall for receiving the end portions of said rod, said receiver comprising a vertically extending slot and a plurality of vertically extending downwardly inclined slots communicating with the vertical slot, whereby the position of the floor can be vertically adjusted within the confines of the side walls and panels by lifting the floor in a vertical direction by sliding the floor rods in the vertical slots of the receivers and then lowering the floor in a vertical direction to insert the floor rods into a selected pair of downwardly inclined slots.

2. A child's stool, according to claim 1, wherein a pair of rods are integral with the bottom surface of the floor, and a pair of receivers are provided in each side wall.

* * * * *